US006738993B2

(12) United States Patent
Marbach

(10) Patent No.: US 6,738,993 B2
(45) Date of Patent: May 25, 2004

(54) ABOVE-GROUND SELF-SUPPORTING SWIMMING POOL

(75) Inventor: Gérard Marbach, Cernay (FR)

(73) Assignee: Sevylor International, Issy les Moulineaux (FR)

( * ) Notice: Subject to any disclaimer, the term of this patent is extended or adjusted under 35 U.S.C. 154(b) by 21 days.

(21) Appl. No.: 10/061,472

(22) Filed: Jan. 31, 2002

(65) Prior Publication Data

US 2002/0100113 A1 Aug. 1, 2002

(30) Foreign Application Priority Data

Jan. 31, 2001 (FR) ..... 01 01303

(51) Int. Cl.[7] ..... E04H 4/00
(52) U.S. Cl. ..... 4/506
(58) Field of Search ..... 4/506, 513

(56) References Cited

U.S. PATENT DOCUMENTS 2,529,872 A * 11/1950 Hasselquist ..... 4/506
2,714,726 A * 8/1955 Hasselquist ..... 4/506
2,718,014 A * 9/1955 Mizrach et al. ..... 4/506
2,719,982 A * 10/1955 Hasselquist ..... 4/506
4,547,919 A * 10/1985 Wang ..... 4/506 X
5,930,849 A * 8/1999 Marbach ..... 4/506
5,946,744 A * 9/1999 Peterson ..... 4/506

FOREIGN PATENT DOCUMENTS

| | | |
|---|---|---|
| FR | 2550572 | 2/1985 |
| FR | 2600988 | 1/1988 |

* cited by examiner

*Primary Examiner*—Charles E. Phillips
(74) *Attorney, Agent, or Firm*—Dean W. Russell; Kilpatrick Stockton LLP

(57) ABSTRACT

A circular above-ground self-supporting pool, comprising a flexible and impervious pocket, the circular upper edge of which is provided with a buoyant inflatable annular hoop, wherein said inflatable hoop consists of several pneumatically independent inflatable annular chambers.

1 Claim, 2 Drawing Sheets

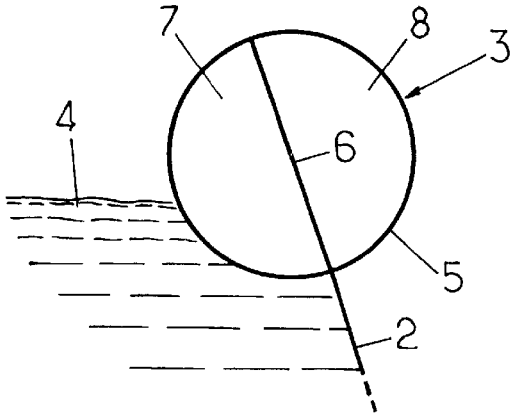
FIG. 2A.
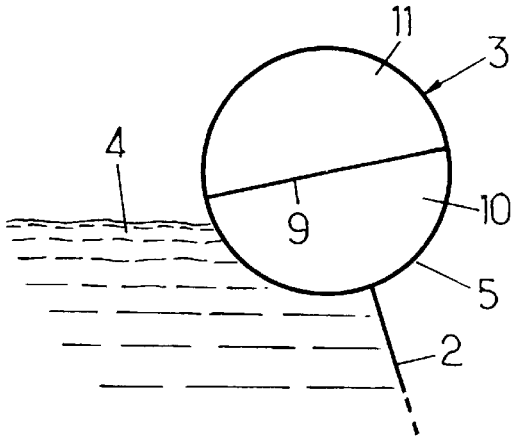
FIG. 2B.
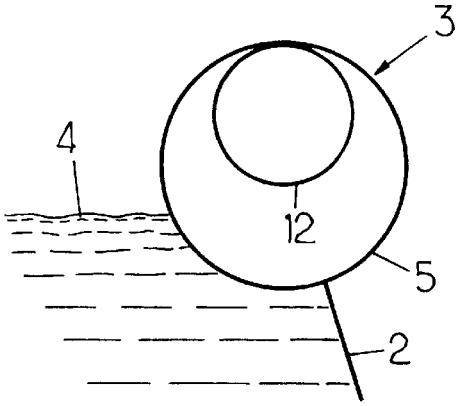
FIG. 3A
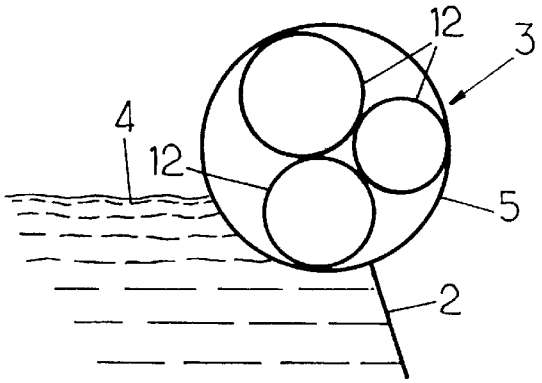
FIG. 3B.
FIG. 4C.
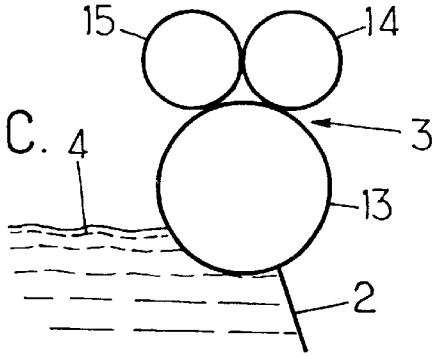

ABOVE-GROUND SELF-SUPPORTING SWIMMING POOL

This application claims priority to French Patent Application No. FR 01 01303 filed on Jan. 31, 2001, the entire contents of which is hereby incorporated by reference.

FIELD OF THE INVENTION

The present invention relates to improvements to the field of circular above-ground self-supporting swimming pools, comprising a flexible and impervious pocket, the circular upper edge of which is provided with a buoyant inflatable annular hoop.

DESCRIPTION OF THE PRIOR ART

Such basins are currently distributed as garden swimming pools and enjoy a great deal of success because of their small volume in the deflated/folded-up state and because of their great ease of use (opening the fabric out flat, inflating the hooping tube, filling with water which gradually causes the floating hoop to rise and gradually tensions the flexible wall (for example made of coated fabric and/or of PVC) under the floating hoop).

However, these pools have a significant drawback which lies in the fact that it is absolutely essential to preserve the integrity of the buoyant annular hoop produced in the form of an inflatable tube. This is because it is this tube inflated with air which, by floating on the surface of the water in the pool, keeps the pocket in a basin shape. If the tube is deflated (for example is punctured or torn, or if the inflation valve leaks), the underlying pocket is no longer supported and there is a risk that it will collapse at least partially if a vertical load is applied to it, thus releasing the water it contains.

It is therefore extremely desirable for the pocket to be kept in its basin shape even if the inflated tube experiences a problem with inflation, either in itself or in its inflation valve.

SUMMARY OF THE INVENTION

It is an object of the invention therefore to propose a structurally simple and effective solution for ensuring the integrity of the pool in the event of damage to the buoyant hoop, so as to avoid at least some of the water contained in the pool spilling out.

To this end, it is anticipated, according to the invention, that a swimming pool as recited in the above preamble be characterized in that said inflatable hoop consists of several independent pneumatically inflatable annular chambers.

Numerous embodiments may be envisaged for that purpose. In particular, it may be envisaged that:

- the inflatable hoop consists of a main tube subdivided by at least one internal partition defining at least two juxtaposed annular chambers; in this case the internal partition may be substantially diametral and lie substantially in the continuation of the wall of the pocket or alternatively substantially transversely to the wall of the pocket;
- or alternatively, the inflatable hoop consists of a main tube containing at least one inner tube of a smaller diameter;
- or alternatively still, the inflatable hoop consists of at least two superposed tubes, and in particular then of a multitude of superposed tubes.

BRIEF DESCRIPTION OF THE DRAWINGS

The invention will be better understood from reading the detailed description of certain embodiments which are given merely by way of non limiting examples. In this description, reference is made to the appended drawings, in which:

FIGS. 2A, 2B; 3A, 3B; 4A, 4B, 4C, are highly schematic views, in cross section, of various embodiments of the buoyant hoop of the pool of FIG. 1 according to the invention.

DETAILED DESCRIPTION OF THE INVENTION

Figure 1:
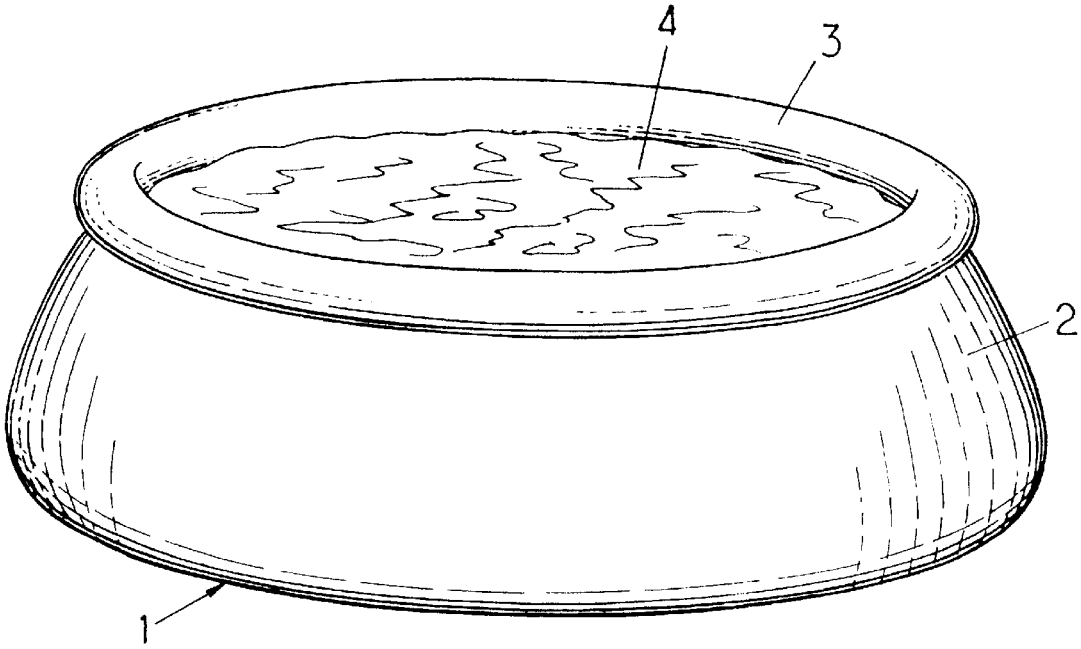
FIG. 1 is an overall perspective view of an above-ground self-supporting pool at which the invention is aimed.

Referring first of all to FIG. 1, the swimming pool, denoted in its entirely by the numerical reference 1, is in the overall shape of a basin open at the top, of round overall shape, filled with liquid 4.

The pool is of the above-ground type, that is to say lying on the ground and erecting above the ground. It is defined by an impervious flexible wall 2 and a bottom, both made for example of a film of PVC or a coated fabric, forming a round pocket. An inflatable hoop 3, of annular shape, surrounds the circular top opening of the basin.

To use it, the basin is unfolded and opened out flat on the ground; the hoop 3 is inflated, for example using air, and adopts its toric shape. Then a liquid (for example water) is poured into the space surrounded by the inflated tube; as the liquid level rises, the hoop 3, which floats, is lifted up, carrying the flexible wall with it upward to form the pocket that holds the liquid.

In equilibrium, the bottom of the basin is pressed onto the ground by the weight of the liquid on top of it; the flexible wall 2 is subjected to the radially directed hydrostatic thrust of the mass of liquid and to the upwardly directed tensile force exerted by the floating hoop 3; and the floating hoop 3 is subjected to upthrust (upwards) and to the downward retaining force exerted by the flexible wall 2 that it supports.

According to the invention, the inflatable hoop 3 consists of several inflatable annular chambers which are pneumatically independent so that if one of them becomes damaged and deflates, the other chamber or chambers continue to float and to support wall 2 of the pocket, thus preventing liquid from flowing out of the pool.

There are various envisageable embodiments for implementing this arrangement.

One first possible embodiment consists in the fact that the inflatable hoop 3 consists of a main tube subdivided (partitioned) by at least one internal partition defining at least two juxtaposed annular chambers.

Thus, in an embodiment illustrated in FIG. 2A, the hoop 3 consists of an inflatable tube 5 which has an internal partition 6 running roughly diametrically and which lies approximately in the continuation of the wall 2 of the pocket. This partition 6 thus defines two juxtaposed annular chambers 7, 8 consisting of the two halves, one situated toward the inside and one toward the outside, of the tube 5.

In another embodiment illustrated in FIG. 2B, the hoop 3 consists of an inflatable tube 5 which has an internal partition 9 running roughly diametrically and which lies approximately transversally to the wall 2 of the pocket. This partition 9 thus defines two juxtaposed annular chambers 10, 11 consisting of the two halves, lower and upper, of the tube 5.

Of course, other arrangements of the partition may be envisaged (particularly a partition which is not diametral, a partition with a different inclination with respect to the wall 2, multiple partitions defining a number of annular chambers greater than 2, etc.).

It will be noted that in this embodiment, regardless of the implementation details, the hoop 3 has the appearance illustrated in FIG. 1, similar to the single-chamber tube provided in pools of the prior art.

A second possible embodiment consists in producing the inflatable hoop 3 in the form of a main tube 5 inside which there is housed at least one inner tube 12 of a smaller diameter. In FIG. 3A, the embodiment illustrated consists in including a single tube 12 of smaller diameter inside the external tube 5, while in FIG. 3B, an embodiment is illustrated that calls upon several (in this instance 3) inner tubes 12. The inner tube or tubes 12 is or are advantageously housed freely inside the outer tube 5, without being fixed to it (except possibly at the location of the inflation valves which may be combined). There again, regardless of the implementation details, the hoop 3 has the appearance illustrated in FIG. 1, similar to that of a single-chamber tube provided in pools of the prior art.

Figure 4A:
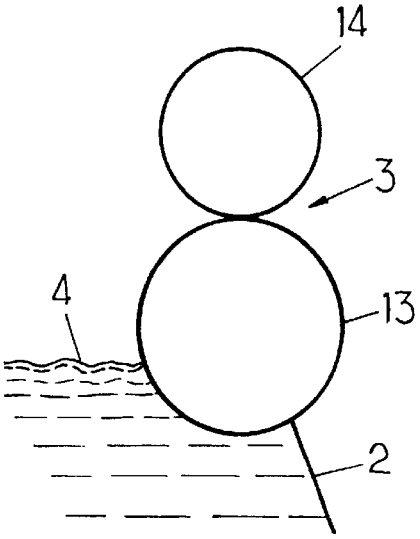
Figure 4B:
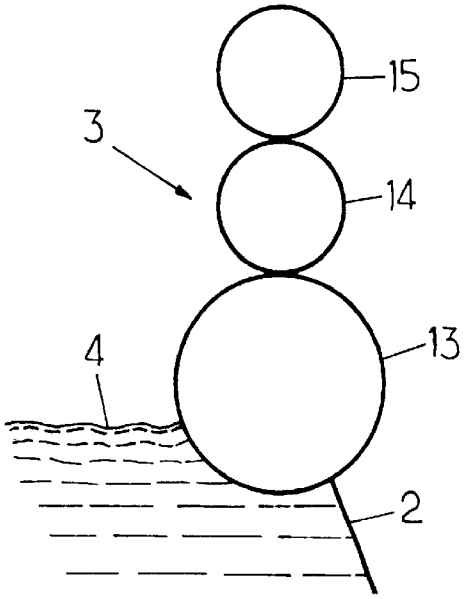

A third possible embodiment consists in forming the hoop 3 in the form of at least two superposed tubes. FIG. 4A illustrates one exemplary embodiment with two superposed tubes 13, 14. FIG. 4B illustrates an embodiment with a multitude (in this instance three) of superposed tubes 13, 14, 15. The superposed tubes may have the same diameter or may alternatively have different diameters, and it is possible thus to form combinations leading to an upper hoop with a particular appearance. Thus, it is possible to envisage that, for example in a three-tube configuration, the two top tubes are not mutually superposed as illustrated in FIG. 4B but are horizontally juxtaposed, in superposition on the lower tube 13, as illustrated in FIG. 4C.

It will also be noted that the various arrangements set out hereinabove can be combined with one another (for example superposition of two tubes as in FIG. 4A, with the lower tube partitioned by an internal partition as in FIG. 2A or 2B, or equipped with (an) inner tube(s) as in FIG. 3A or 3B).

What is claimed is:

1. A circular above-ground swimming pool, comprising a flexible and impervious pocket, the circular upper edge of which is provided with a buoyant inflatable annular hoop, wherein said inflatable hoop comprises a plurality of pneumatically independent inflatable annular chambers formed from a main tube subdivided by at least one internal partition defining at least two juxtaposed annular chambers, and wherein said internal partition is substantially diametral and lies substantially in the continuation of the wall of the pocket.

* * * * *